United States Patent [19]

Grierson et al.

[11] Patent Number: 4,640,818

[45] Date of Patent: Feb. 3, 1987

[54] CORROSION INHIBITION OF METALS IN WATER SYSTEMS USING AMINOPHOSPHONIC ACID DERIVATIVES IN COMBINATION WITH MANGANESE

[75] Inventors: Jeffrey G. Grierson, Angleton; Carol A. Jones, Sweeny; William D. Spears, West Columbia, all of Tex.

[73] Assignee: The Dow Chemical Company, Midland, Mich.

[21] Appl. No.: 744,190

[22] Filed: Jun. 13, 1985

Related U.S. Application Data

[63] Continuation-in-part of Ser. No. 641,649, Aug. 17, 1984, abandoned.

[51] Int. Cl.[4] ..... C23F 11/18; C23F 11/16; C09K 3/00

[52] U.S. Cl. ..... 422/15; 422/19; 252/181; 252/389.22; 252/389.53

[58] Field of Search ..... 422/15, 19; 252/181, 252/389.22, 389.53

[56] References Cited

U.S. PATENT DOCUMENTS

| | | | |
|---|---|---|---|
| 3,091,522 | 5/1963 | Hemwall | 71/1 |
| 3,214,454 | 10/1965 | Blaser et al. | 260/429.9 |
| 3,288,846 | 11/1966 | Irani et al. | 260/500 |
| 3,398,198 | 8/1969 | Kersnar et al. | 260/584 |
| 3,532,639 | 10/1970 | Hatch | 252/389 |
| 3,714,067 | 1/1973 | King et al. | 252/389 A |
| 3,726,912 | 4/1973 | McCrary et al. | 260/513 |
| 3,738,806 | 6/1973 | Feller, Jr. | 21/27 |
| 3,816,333 | 6/1974 | King et al. | 252/389 A |
| 3,837,803 | 9/1974 | Carter et al. | 422/13 |
| 3,899,293 | 8/1975 | Bush | 252/389.22 X |
| 3,974,090 | 8/1976 | Mitchell | 252/389 A |
| 4,033,896 | 7/1977 | Mitchell et al. | 252/389 A |
| 4,085,134 | 4/1978 | Redmore et al. | 260/502.5 |
| 4,307,038 | 12/1981 | Sommer et al. | 260/502.5 |
| 4,459,241 | 7/1984 | Wilson et al. | 260/502.5 |
| 4,489,203 | 12/1984 | Wilson et al. | 544/337 |
| 4,500,469 | 2/1985 | Simon et al. | 260/502.5 |
| 4,500,470 | 2/1985 | Wilson | 260/502.5 |

OTHER PUBLICATIONS

Roger G. Lacoste and Arthur E. Martell, "Preparation and Properties of Aminomethylenesulfonic Acids", *J. Am. Chem. Soc.*, vol. 77, pp. 5512–5514.

*Primary Examiner*—Edward A. Miller
*Assistant Examiner*—Matthew A. Thexton
*Attorney, Agent, or Firm*—A. C. Ancoma

[57] ABSTRACT

The invention is an improved process for inhibiting corrosion of metals in water conducting systems. It comprises employing in combination a compound of manganese together with organic aminoalkylenephosphonic acid derivatives to the water in such systems. These amine derivative compounds may also contain other functional groups, e.g., carboxylates, quaternary amines, hydroxyalkyl groups and the like.

75 Claims, No Drawings

CORROSION INHIBITION OF METALS IN WATER SYSTEMS USING AMINOPHOSPHONIC ACID DERIVATIVES IN COMBINATION WITH MANGANESE

CROSS-REFERENCE TO RELATED APPLICATION

This application is a continuation-in-part of our copending application Ser. No. 641,649, filed Aug. 17, 1984, now abandoned.

BACKGROUND OF THE INVENTION

One of the main problems which occurs in hydraulic engineering is the corrosion of metals in both treated and untreated cooling water systems. The corrosion of metals such as steel, aluminum, brass and copper which are commonly found in water systems, is primarily due to dissolved oxygen and carbon dioxide. Materials which remove oxygen such as sodium sulfite or hydrazine are not economical and are technically inadequate. Hence $Zn^{++}$, chromates, molybdates, polyphosphates, ortho-phosphate, and organo-phosphonates are added to cooling water to form protective films on metal surfaces. Chromates are very efficient corrosion inhibitors. However, they are often environmentally undesirable due to the well known toxic effects. $Zn^{++}$ has similar environmental problems and it also has low solubility products with ortho phosphates, hydroxide and carbonate which can form sludge and deposits responsible for promoting corrosion. Polyphosphates are not as efficient as chromates and they are unstable in a cooling water environment, thus they decompose by hydrolysis to ortho and pyro-phosphates which often cause sludge and deposits. Ortho-phosphates are not as efficient as chromates and if they are not controlled properly they can also form sludge and deposits. Although organophosphonates provide some corrosion protection, they are not nearly as efficient as chromates.

SUMMARY OF THE INVENTION

The invention is an improved process for inhibiting corrosion of metals in water conducting systems. It comprises employing in combination a compound of manganese together with aminoalkylenephosphonic acid derivatives in such systems. These aminophosphonic acid derivatives may also contain other functional groups, e.g., carboxyl, quaternary amine, hydroxyalkyl groups and the like. The manganese compound must be capable of providing a manganese ion in the aqueous system.

DETAILED DESCRIPTION OF THE INVENTION

We have now found synergistic combinations comprising manganese compounds together with aminoalkylenephosphonic acid derivatives or their salts which provide metal corrosion protection comparable to chromates. The various aminoalkylenephosphonic acid derivatives tested alone in hard or deionized water do not provide this level of protection. The corrosion protection of metals by aminoalkylenephosphonic acid derivatives, however, is enhanced by the addition of a manganese compound to provide a source of manganese ion.

The organic phosphonic acid derivatives which have been useful in inhibiting corrosion of metals in the presence of manganese ions are aminophosphonic acid derivatives wherein the nitrogen and phosphorus are interconnected by an alkylene or substituted alkylene group, having the formula

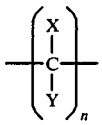

wherein X, Y are independently selected from hydrogen, hydroxyl, carboxyl, phosphonic, salts of the acid radicals and hydrocarbon radicals having from 1–12 carbon atoms and wherein n is 1–3, with the proviso that when $n>1$, each X and Y may be the same as or different from any other X or Y on any carbon atom.

The compounds can be prepared by a number of known synthetic techniques. Of particular importance is the reaction of compounds containing reactive amine hydrogens with a carbonyl compound (aldehyde or ketone) and phosphorous acid or derivative thereof. Detailed procedures can be found in U.S. Pat. No.3,288,846.

The following structural formulas represent some of the complexing ligands which can be used in combination with the $Mn^{++}$ ion in inhibiting corrosion in the practice of the present invention:

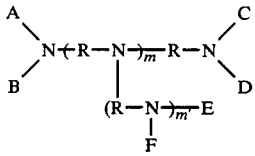

wherein substituents A, B, C, D, E and F are independently selected from hydrogen,

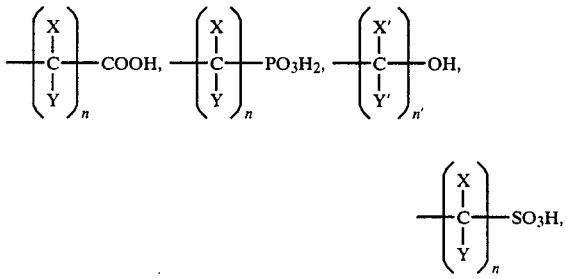

2-hydroxy-3-trialkylammonium halide)propyl and 2-hydroxypropylsulfonic acid groups and salts of the acid radicals wherein X, Y, and n have been previously defined, X′ and Y′ are independently hydrogen, methyl or ethyl radicals, n′ is 2 or 3 and m and m′ each is 0–2500, with the proviso that at least about 50 percent of the amine hydrogens have been substituted by the phosphorus-containing group as previously defined herein, and wherein R is a hydrocarbon residue which can be a linear, branched, cyclic, heterocyclic, substituted heterocyclic, or a fused ring-type structure; with the further proviso that when m or $m' \geqq 1$ the E and F substituents may be the same as or different from any other substituent of any other nitrogen atom and each R can be the same as or different from any other R.

Some specific, but non-limiting, examples of compounds which are included by the above structures are bis(aminomethyl)dicyclopentadienetetra(methylenephosphonic acid), bis(aminomethyl)bicycloheptanetetra(methylenephosphonic acid), ethylenediaminetetra(methylenephosphonic acid) (EDA-TMP), diethylenetriaminepenta(methylenephosphonic acid) (DETA-PMP), hydroxyethylethylenediaminetri(methylenephosphonic acid) (HEEDA-TMP), pentaethylenehexamineocta(methylenephosphonic acid), hexamethylenediaminetetra(methylenephosphonic acid), phosphonomethylated polyalkylene polyamines having molecular weights up to about 100,000 or more, which may contain piperazine rings in the chain, [N-3-trialkylammonium-2-hydroxypropyl)diethylenetriaminetetra(methylenephosphonic acid)]chloride, diethylenetriaminemonocarboxymethyltetra(methylenephosphonic acid), ethylenediaminemono-2-hydroxypropylsulfonictri(methylenephosphonic acid), piperazinedimethylenephosphonic acid. The dicyclopentadiene and the bicycloheptane derivatives contain the dimethyltricyclodecane and dimethylnorborane radicals, respectively.

Additional compounds useful in metal corrosion inhibition in the presence of manganese ions are disclosed in "New Metal Ion Control Agents Based on Dicyclopentadiene Derivatives", U.S. Pat. No. 4,500,470; "New Compounds Containing Quaternary Ammonium and Methylenephosphonic Acid Groups", U.S. Pat. No. 4,459,241; "Polymeric Alkylenephosphonic Acid Piperazine Derivatives", U.S. Pat. No. 4,489,203, "Bis(aminoalkyl)Piperazine Derivatives And Their Use As Metal Ion Control Agents", Ser. No. 583,526, filed Feb. 24, 1984; and "New Metal Ion Control Compounds Based On Norbornane", U.S. Pat. No. 4,500,469.

Organophosphonic acid derivatives containing other functional groups in addition to an alkylenephosphonic acid group (U.S. Pat. No. 3,288,846) as a nitrogen substituent can be prepared by the following methods.

Hydroxyalkyl groups can be substituted for a hydrogen of an amine by reacting the amine with an alkylene oxide in aqueous medium, e.g. propylene oxide(1,2-epoxypropane), as described in U.S. Pat. No. 3,398,198.

Alkylsulfonic acid groups can be substituted for an amine hydrogen by reacting the amine with a mixture of sodium bisulfite and an aldehyde, e.g. formaldehyde, to obtain an alkylenesulfonic acid group substituent on the nitrogen of the amine compound. This reaction is taught in "Preparation and Properties of Aminomethylenesulfonic Acids", *J. Am. Chem. Soc.* 77, 5512–15 (1955). Other alkylsulfonic acid derivatives can be made by reacting the amine with chloroalkylsulfonic acids or as in U.S. Pat. No. 4,085,134 by reacting propane sultone with an amine.

Carboxyalkyl groups can be substituted for the hydrogens by reacting the alkali metal salt of organophosphonic amine derivative in alkaline medium with $\alpha,\beta$-unsaturated carboxylic acids or their anhydrides, esters or nitriles. This process is more completely described in U.S. Pat. No.4,307,038.

Another method for obtaining carboxyalkyl groups as substituents of the amine nitrogens is found in U.S. Pat. No. 3,726,912.

The 2-hydroxypropylsulfonic acid group may be substituted for an amine hydrogen by reacting the amine in aqueous solution with 3-chloro-2-hydroxy-1-propanesulfonic acid in the presence of caustic (NaOH). The hydroxypropylsodiumsulfonate group is the nitrogen substituent. If the acid id desired, acidification with a strong acid, e.g. HCl is sufficient to convert the sodium salt to the acid. This reaction is taught in U.S. Pat. No. 3,091,522.

The hydroxypropyltrimethylammonium chloride group may be substituted for an amine hydrogen by reacting the amine with an aqueous solution of 3-chloro-2-hydroxypropyltrimethylammonium chloride prior to the reaction to make the phosphonic acid derivative.

For the purpose of the present invention, effective aminophosphonic acid derivatives described herein and salts thereof are considered equivalent. The salts referred to are the acid addition salts of those bases which will form a salt with at least one acid group of the aminophosphonic acid derivative. Suitable bases include, for example, the alkali metal and alkaline earth metal hydroxides, carbonates, and bicarbonates such as sodium hydroxide, potassium hydroxide, calcium hydroxide, potassium carbonate, sodium bicarbonate, magnesium carbonate and the like, ammonia, primary, secondary and tertiary amines and the like. These salts may be prepared by treating the aminophosphonic acid derivative having at least one acid group with an appropriate base.

The preferred quantity of the aminoalkylenephosphonic acid derivatives to inhibit corrosion of either copper- or iron-containing metal alloys in water conducting systems is from about 2 to about 50 ppm acid or equivalent. The operable amounts are from 1 to about 300 ppm. The addition of manganese compounds to the aminophosphonic acid derivatives in such water conducting systems has an unexpected enhancement of inhibiting corrosion. The present invention is the use of this combination to inhibit corrosion. The manganese compound is employed in an amount to provide from about 0.1 to about 30 ppm manganese by weight in the aqueous solution. Preferred amounts provide from about 0.2 to about 10 ppm. Representative of suitable manganese compounds which may be employed as a source of manganese ion are MnO, $MnO_2$, $MnCl_2.4H_2O$, $KMnO_4$, $Mn(CH_3COO)_2.4H_2O$ and the like. The manganese compound can be added simultaneously with the aminophosphonic acid derivative or may be added separately to the water. Alternatively, the manganese can be complexed by the aminophosphonic acid compound prior to adding to the water. Preferred is a composition in which the weight ratio of aminophosphonic acid derivative to manganese is at least about 2 to 1.

While zinc compounds have been used in conjunction with aminophosphonic acid derivatives in the art, the use of manganese compounds together with the aminophosphonic acid derivatives provides unexpectedly superior results. Some comparisons are shown in Table II.

The following examples are representative of the invention:

EXAMPLE 1

This example demonstrates the enhanced corrosion inhibition of 1018 carbon steel provided by manganese with a commercially available aqueous solution of DETA-PMP.

Tanks of 8 liter capacity were filled with tap water having the following characteristics:

| WATER CHARACTERISTICS | |
|---|---|
| Conductivity (μmhos/cm) | 750 |

-continued

| WATER CHARACTERISTICS | |
|---|---|
| Alkalinity (ppm as $CaCO_3$) | 120 |
| Total Hardness (ppm as $CaCO_3$) | 178 |
| Ca Hardness (ppm as $CaCO_3$) | 136 |
| Fe (ppm) | 0.28 |
| $SO_4^=$ (ppm) | 85 |
| $Cl^-$ (ppm) | 126 |
| pH | 7.4 |

Air was sparged at 10 SCFH through a glass tube which was situated at one end of the tank and extended to the bottom of the tank. The air sparge was used to recirculate the water, oxygenate the water, and aid in evaporation. Water level in the tank was automatically controlled by a gravity feed system and heat was added to the water by electric immersion heaters. The water temperature was measured by a platinum RTD* and controlled at 125° F. (51.7° C.) by an "on/off" controller which provided power to the immersion heaters. The pH of the water was adjusted to pH 8.0 by addition of caustic (50%) and was automatically maintained at 8.0 by a controller which fed HCl to the tank in response to an increase in pH.

*RTD=resistance temperature detector

The DETA-PMP (100 ppm) was added to each of Tanks 1 and 2. Manganese (5 ppm) as $MnCl_2.4H_2O$ was added to Tank 1 only. The pH of each tank was initially adjusted to 8.0 using NaOH. Carbon steel (1018) electrodes which had been cleaned with 1:1 HCl and sanded with 320 grade sandpaper to remove all surface oxides were attached to three electrode corrosion probes and immersed in the tanks. The corrosion rates were monitored using a potentiostatic corrosion rate instrument. Unless otherwise noted, the experiments were conducted for a period of five days at which time the concentration of salts in the baths was approximately four times that in the feed water.

At the end of this time the average corrosion rates from all runs were found to be 0.5 mpy** for Tank 1 and 2.45 mpy for Tank 2.

**mpy=mils per year metal lost

Comparative Examples A, B and C were conducted without manganese, without the aminophosphonic acid derivative and with no additives, respectively, under the same conditions of temperature, pH and using the same water and metal as used in Example 1. All were evaluated over a five day period. Results are shown in Table I in which all examples of the invention are shown by numbers and the comparative examples are shown by letters.

EXAMPLES 2 AND 3

Experiments were conducted in the manner of Example 1, using different sources of manganese with the same aminophosphonic acid derivatives. Results are shown in Table I. In the case of using MnO, or other insoluble sources of manganese, it is added to a solution of the phosphonic acid derivative in which the compound will dissolve and then added to the water system.

EXAMPLE 4

An experiment using DETA-PMP and manganese ion as $MnCl_2.4H_2O$ and a no-treatment control was performed to determine the effects on Admiralty brass* corrosion rates. These were conducted according to the procedure in Example 1 except that the test was run for 9 days and Admiralty brass electrodes were used. The average corrosion rates for these tests are also shown in Table I. Examples D and E are for comparison with Example 4 using Admiralty brass.

*Brass CDA-443

EXAMPLE 5

Ethyleneamine E-100* (E-100-MP) was substantially completely phosphonomethylated and used in experiments conducted as described in Example 1. Results are shown in Table I.

*Ethyleneamine E-100 is a product of The Dow Chemical Company described as a mixture of pentaethylenehexamine and heavier ethylene amines including those polymers containing piperazine structures with an approximate average molecular weight of 275.

EXAMPLE 6

An experiment was conducted in the manner of Example 5 except that deionized water was employed in place of tap water. A comparison without manganese (Example F) was also run. Results are shown in Table I.

EXAMPLE 7

Ethyleneamine E-100 having 10 mole percent of the amine hydrogens substituted by 2-hydroxy-3-trimethylammonium chloride)propyl groups and substantially all the rest by methylenephosphonic acid groups (E-100-QMP) was tested under the same conditions as described in Example 1. Tanks 3 (this example) and 4 (Example G) were loaded with 100 ppm of active product and Tank 3 contained additionally 5 ppm manganese as $MnCl_2.4H_2O$. At the end of 5 days the average corrosion rates on 1018 carbon steel electrodes were 0.75 mpy for Tank 3 and 1.7 mpy for Tank 4.

EXAMPLE 8

Ethylenediamine having 25 mole percent of its amine hydrogens substituted by 2-hydroxypropylsulfonic acid groups and substantially all its remaining amine hydrogens substituted by methylenephosphonic acid groups (EDA-HPS-MP) was tested according to the method in Example 1, at 150 ppm of active material alone and with 7.5 ppm of manganese as $MnCl_2.4H_2O$. After 5 days the average corrosion rates for carbon steel 1018 were 1.5 mpy without manganese (Example H) and 0.7 mpy with manganese (this example).

EXAMPLE 9

A polyalkylene polyamine* of ~100,000 molecular weight, having 25 mole percent of its amine hydrogens substituted by 2-hydroxy-3-trimethylammonium chloride)propyl groups and substantially all its remaining amine hydrogens substituted by methylenephosphonic acid groups (PAPA-QMP), was tested according to the method in Example 1. The tests were performed with 94 ppm of this phosphonic acid derivative alone (Example I) and with 5 ppm manganese as $MnCl_2.4H_2O$ (this example). The average corrosion rates for carbon steel at the end of the tests were 2.5 mpy without Mn and 0.3 mpy with Mn.

*This polyalkylenepolyamine is prepared by reacting the E-100 product referred to above with ethylene dichloride (EDC) to form a high molecular weight product containing branching structures and cyclic rings, e.g. piperazine.

EXAMPLE 10

Tests using the substantially completely phosphonomethylated ethyleneamine E-100 product described in Example 5 were performed in combination with $KMnO_4$ according to the procedure of Example 1. The phosphonomethylated ethyleneamine E-100 product was added at a concentration of 100 ppm with 5 ppm of manganese as $KMnO_4$. The final average corrosion rate on 1018 carbon steel electrodes was 0.58 mpy.

The following additional comparative examples (J and K), using a non-amine based phosphonic acid, show that the use of manganese ion provides no significant improvement with these derivatives (See Table I).

EXAMPLES J AND K (BOTH COMPARATIVE)

Tests using 1-hydroxyethylidene-1,1 diphosphonic acid (HEDP) and manganese ion as $MnCl_2.4H_2O$ were performed according to the procedure described in Example 1. The experiments were conducted with 100 ppm of active HEDP in both Tanks 1 (K) and 2 (J). Tank 2 contained, in addition, 5 ppm manganese as $MnCl_2.4H_2O$. The average corrosion rates for carbon steel electrodes were 7.8 mpy for Tank 1 and 8.2 mpy for Tank 2.

TABLE I

| Example No. | Organo-Phosphonic Acid Deriv. | Amt. (ppm) | Mn Source | $Mn^{++}$ (ppm) | Corrosion (mpy) |
|---|---|---|---|---|---|
| 1 | DETA-PMP | 100 | $MnCl_2$ | 5.0 | 0.50 |
| A | DETA-PMP | 100 | — | — | 2.45 |
| B | — | — | $MnCl_2$ | 5.0 | 10.00 |
| C | Control | (no additives) | | — | 10.00 |
| 2 | DETA-PMP | 150 | $MnCl_2$ | 7.5 | 0.36 |
| 3 | DETA-PMP | 150 | MnO | 7.5 | 0.39 |
| 4 | DETA-PMP | 200 | $MnCl_2$ | 10.0 | 0.25 |
| D | DETA-PMP | 200 | — | — | 8.00 |
| E | DETA-PMP | — | — | — | 0.61 |
| 5 | E-100-MP | 87 | $MnCl_2$ | 5.0 | 0.44 |
| 6 | E-100-MP | 142 | $MnCl_2$ | 5.0 | 0.77 |
| F | E-100-MP | 142 | — | — | 6.25 |
| 7 | E-100-QMP | 100 | $MnCl_2$ | 5.0 | 0.75 |
| G | E-100-QMP | 100 | — | — | 1.70 |
| 8 | EDA-HPS-MP | 150 | $MnCl_2$ | 7.5 | 0.70 |
| H | EDA-HPS-MP | 150 | — | — | 1.50 |
| 9 | PAPA-QMP | 94 | $MnCl_2$ | 5.0 | 0.30 |
| I | PAPA-QMP | 94 | — | — | 2.50 |
| 10 | E-100-MP | 100 | $KMnO_4$ | 5.0 | 0.58 |
| J | HEDP | 100 | $MnCl_2$ | 5.0 | 8.20 |
| K | HEDP | 100 | — | — | 7.80 |

Table II shows results employing some of the phosphonic acid derivatives of the present invention together with $Mn^{++}$ as compared to the same derivatives employed with $Zn^{++}$. Examples of the invention are numbered, while the comparative examples are indicated by letters in the same manner as in Table 1.

EXAMPLES 11-14 AND L-P

Experiments were run in the manner of Example 1 employing $Mn^{++}$ ion in combination with various phosphonomethylated organic amines (Examples 5 and 11-14) and for comparison the same compounds were used in combination with the $Zn^{++}$ ion (Examples L-P) as generically disclosed in the prior art. These compounds are the E-100-MP of Example 5, the DETA-PMP of Example 4, Poly AEP-MP, described in the footnote to Table II, the PAPA-PMQ of Example 9 and HEEDA-TMP. The manganese and zinc ions were compared on an equal molar basis ($9\times10^{-5}$ moles/liter).

TABLE II

| Example No. | Organo-Phosphonic Acid Deriv. | Amt (ppm) | $Mn^{++}$ Ion Source | $Mn^{++}$ Ion ppm | $Zn^{++}$ Ion Source | $Zn^{++}$ Ion ppm | Corrosion (mpy) |
|---|---|---|---|---|---|---|---|
| C | Control | — | — | — | — | — | 10.00 |

TABLE II-continued

| Example No. | Organo-Phosphonic Acid Deriv. | Amt (ppm) | $Mn^{++}$ Ion Source | $Mn^{++}$ Ion ppm | $Zn^{++}$ Ion Source | $Zn^{++}$ Ion ppm | Corrosion (mpy) |
|---|---|---|---|---|---|---|---|
| 5 | E-100-MP | 87 | $MnCl_2$ | 5.0 | — | — | 0.44 |
| L | E-100-MP | 87 | — | — | $ZnCl_2$ | 6.2 | 1.37 |
| 11 | DETA-PMP | 100 | $MnCl_2$ | 5.0 | — | — | 0.60 |
| M | DETA-PMP | 100 | — | — | $ZnCl_2$ | 6.0 | 1.40 |
| 12 | Poly AEP*-MP | 100 | $MnCl_2$ | 5.0 | — | — | 0.20 |
| N | Poly AEP*-MP | 100 | — | — | $ZnCl_2$ | 6.0 | 0.45 |
| 13 | PAPA-QMP | 100 | $MnCl_2$ | 5.0 | — | — | 0.66 |
| O | PAPA-QMP | 100 | — | — | $ZnCl_2$ | 6.0 | 2.10 |
| 14 | HEEDA-TMP | 100 | $MnCl_2$ | 5.0 | — | — | 0.53 |
| P | HEEDA-TMP | 100 | — | — | $ZnCl_2$ | 6.0 | 0.73 |

*Poly AEP is the reaction product of 1 mole aminoethylpiperazine (AEP) with 0.56 mole of EDC. This product was substantially completely phosphonomethylated.

The organic aminophosphonic acid derivative and manganese ion employed according to the invention are also operable in the presence of other additives commonly used in the water of cooling systems, providing of course, there is no adverse effect as a result of the use of such combinations. Some representative additives are dispersants such as polyacrylates, polymethacrylates, polymaleic anhydride, acrylate/methacrylate and acrylate/acrylamide copolymers; biocides such as 2,2-dibromo-2-nitrilopropionamide, bis(tributyltin)oxide, chlorine, chlorine dioxide and bromine chloride; antifoam agents and the like. Other ion control agents including phosphate esters, phosphonates and sulfonates and corrosion inhibitors such as zinc, polyphosphates, tolyltriazole and the like may also be present, providing, as before indicated, there is no adverse effect.

EXAMPLE 15

An industrial open recirculation cooling system was operated in accordance with the present invention in which DETA-PMP was maintained at a concentration within the range of 3 to 10 ppm and the manganese ion maintained at a concentration within the range of 0.2 to 1.0 ppm. The cooling system water also had been chlorinated to prevent the growth of slime amd algae. It also contained a commercially available polyacrylic acid-based dispersant, a non-oxidizing biocide and an antifoam agent (added as needed). The corrosion rates of carbon steel and Admiralty brass were measured using both potentiostatic techniques and corrosion coupons. The maximum corrosion rates for carbon steel were less than 1.5 mpy and for Admiralty brass were less than 0.1 mpy as determined by both methods.

We claim:

1. A composition useful in inhibiting metal corrosion in water conducting systems comprising, in combination, (a) an organic aminophosphonic acid derivative, wherein the nitrogen and phosphorus are inter-connected by an alkylene or substituted alkylene radical having the formula

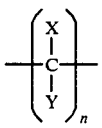

wherein X, Y are independently selected from hydrogen, hydroxyl, carboxyl, phosphonic, salts of the acid radicals and hydrocarbon radicals having from 1–12 carbon atoms and wherein n is 1–3, with the proviso that when $n>1$, each X and Y may be the same as or different from any other X or Y on any carbon atom, and (b) a manganese compound capable of providing a manganese ion.

2. The composition of claim 1 wherein the manganese ion is in a chelated form.

3. The composition of claim 1 wherein the organic aminophosphonic acid derivative has the structure of

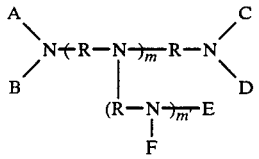

wherein substituents A, B, C, D, E and F are independently selected from hydrogen,

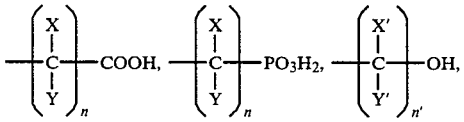

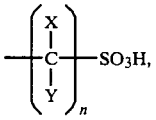

2-hydroxy-3-trialkylammonium halide)propyl and 2-hydroxypropylsulfonic acid groups and salts of the acid radicals wherein X, Y, and n have been previously defined, X′ and Y′ are independently hydrogen, methyl or ethyl radicals, n′ is 2 or 3 and m and m′ each is 0–2500, with the proviso that at least about 50 percent of the amine hydrogens have been substituted by the phosphorus-containing group as previously defined herein, and wherein R is a hydrocarbon residue which can be a linear, branched, cyclic, heterocyclic, substituted heterocyclic, or a fused-ring structure; with the further proviso that when m or $m' \geqq 1$ the E and F substituents may be the same as or different from any other substituent of any other nitrogen atom and each R can be the same as or different from any other R.

4. The composition of claim 3 wherein the manganese ion is in a chelated form.

5. The composition of claim 3 wherein m is 0 and R is $-CH_2CH_2-$.

6. The composition of claim 5 wherein A, B, C and D are independently selected from

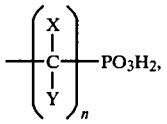

2-hydroxypropylsulfonic acid groups and salts thereof.

7. The composition of claim 6 wherein about 25 mole percent of the substituent groups are 2-hydroxypropylsulfonic acid groups and substantially all the remainder are

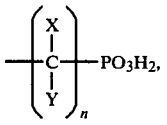

or salts of the acid groups, X and Y are hydrogen and n is 1.

8. The composition of claim 3 wherein m is 1, R is $-CH_2CH_2-$ and m′ is 0.

9. The composition of claim 8 wherein substantially all of the substituent groups, A, B, C, D and E, are

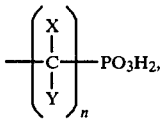

a salt thereof or a mixture thereof and X and Y are each hydrogen and n is 1.

10. The composition of claim 5 wherein at least one of the nitrogen substituents is

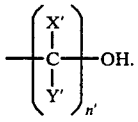

11. The composition of claim 10 wherein X′ and Y′ are each hydrogen.

12. The composition of claim 11 wherein n′ is 2 and substantially all the remaining nitrogen substituents are

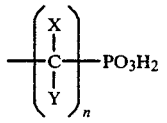

or a salt thereof, and X and Y are each hydrogen and n is 1.

13. The composition of claim 7 wherein the manganese is in a chelated form.

14. The composition of claim 9 wherein the manganese is in a chelated form.

15. The composition of claim 12 wherein the manganese is in a chelated form.

16. The composition of claim 1 wherein the organic aminophosphonic acid is derived from a polyalkylenepolyamine wherein at least about 50 percent of the amine hydrogens have been substituted by methylenephosphonic acid groups or salts thereof.

17. The composition of claim 16 wherein at least about 10 percent of the amine hydrogens have been substituted by 2-hydroxy-3-trialkylammonium halide)-propyl groups and substantially all the remainder have been substituted by methylenephosphonic acid groups or salts thereof.

18. The composition of claim 16 wherein at least about 25 percent of the amine hydrogens have been substituted by 2-hydroxy-3-trialkylammonium halide)-propyl groups and substantially all the remainder have been substituted by methylenephosphonic acid groups or salts thereof.

19. The composition of claim 17 wherein the polyalkylenepolyamine precursor has an average molecular weight of about 275.

20. The composition of claim 18 wherein the polyalkylenepolyamine precursor has a molecular weight of about 100,000.

21. The composition of claim 16 wherein substantially all of the amine hydrogens have been substituted by methylenephosphonic acid groups or salts thereof.

22. The composition of claim 21 wherein the precursor amine is the reaction product of aminoethylpiperazine and ethylene dichloride in the mole ratio of 1 to 0.56, respectively.

23. The composition of claim 19 wherein the manganese is in a chelated form.

24. The composition of claim 20 wherein the manganese is in a chelated form.

25. The composition of claim 21 wherein the manganese is in a chelated form.

26. The composition of claim 22 wherein the manganese is in a chelated form.

27. The composition of claim 21 wherein the polyalkylenepolyamine precursor has an average molecular weight of about 275.

28. The composition of claim 27 wherein the manganese ion is in a chelated form.

29. The composition of claim 1 which optionally contains a dispersing agent.

30. The composition of claim 3 which optionally contains a dispersing agent.

31. The composition of claim 30 wherein the dispersing agent is a polymer of acrylic acid, methacrylic acid or maleic anhydride or a copolymer of acrylic and methacrylic acids, acrylic acid and acrylamide or salts thereof.

32. The composition of claim 30 wherein the dispersing agent is a polyacrylic acid based dispersant.

33. The composition of claim 10 which optionally contains a dispersing agent.

34. The composition of claim 33 wherein the dispersing agent is a polyacrylic acid based dispersant.

35. The composition of claim 1 which optionally contains a biocide.

36. The composition of claim 3 which optionally contains a biocide.

37. The composition of claim 36 wherein the biocide is 2,2-dibromo-2-nitrilopropionamide or bis(tributyltin-)oxide.

38. The composition of claim 3 which optionally contains an antifoam agent.

39. A method of inhibiting the corrosion of metals in water conducting systems which comprises supplying to said water in combination (a) an organic aminophosphonic acid derivative, wherein the nitrogen and phosphorus are interconnected by an alkylene or substituted alkylene radical, having the formula

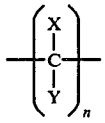

wherein X, Y are independently selected from hydrogen, hydroxyl, carboxyl, phosphonic, salts of the acid radicals and hydrocarbon radicals having from 1–12 carbon atoms and wherein n is 1–3, with the proviso that when $n>1$, each X and Y may be the same as or different from any other X or Y on any carbon atom, and (b) a manganese compound capable of providing a manganese ion.

40. The method of claim 39 wherein the manganese ion is supplied in a chelated form.

41. The method of claim 39 wherein the organic aminophosphonic acid derivative has the structure of

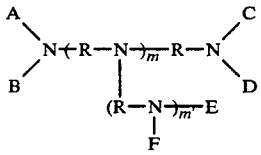

wherein substituents A, B, C, D, E and F are independently selected from hydrogen,

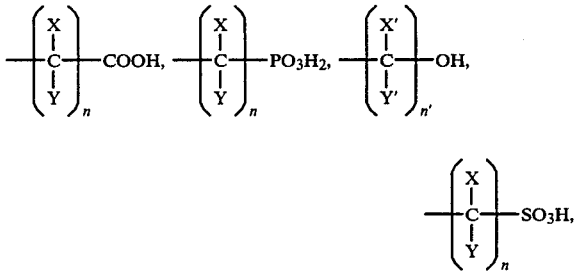

2-hydroxy-3-(trialkylammonium halide)propyl and 2-hydroxypropylsulfonic acid groups and salts of the acid radicals wherein X, Y, and n have been previously defined, X′ and Y′ are independently hydrogen, methyl or ethyl radicals, n′ is 2 or 3 and m and m′ each is 0–2500, with the proviso that at least about 50 percent of the amine hydrogens have been substituted by the phosphorus-containing group as previously defined herein, and wherein R is a hydrocarbon residue which can be a linear, branched, cyclic, heterocyclic, substituted heterocyclic, or a fused ring-type structure; with the further proviso that when m or $m' \geqq 1$ the E and F substituents may be the same as or different from any other substituent of any other nitrogen atom and each R can be the same as or different from any other R.

42. The method of claim 41 wherein the manganese ion is supplied in a chelated form.

43. The method of claim 41 wherein m is 0 and R is $—CH_2CH_2—$.

44. The method of claim 43 wherein A, B, C and D are independently selected from

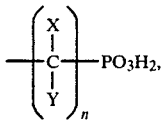

2-hydroxypropylsulfonic acid groups and salts thereof.

45. The method of claim 44 wherein about 25 mole percent of the substituent groups are 2-hydroxypropylsulfonic acid groups and substantially all the remainder are

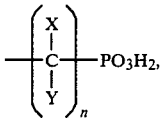

or salts of the acid groups, X and Y are hydrogen and n is 1.

46. The method of claim 41 wherein m is 1, R is —$CH_2CH_2$— and m′ is 0.

47. The method of claim 46 wherein substantially all of the substituent groups A, B, C, D and E, are

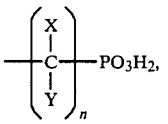

a salt thereof or a mixture thereof and X and Y are each hydrogen and n is 1.

48. The method of claim 43 wherein at least one of the nitrogen substituents is

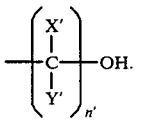

49. The method of claim 48 wherein X′ and Y′ are each hydrogen.

50. The method of claim 49 wherein n′ is 2 and substantially all of the remaining nitrogen substituents are

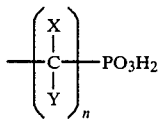

or a salt thereof and X and Y are each hydrogen and n is 1.

51. The method of claim 45 wherein the manganese is supplied in a chelated form.

52. The method of claim 47 wherein the manganese ion is supplied in a chelated form.

53. The method of claim 50 wherein the manganese is supplied in a chelated form.

54. The method of claim 39 wherein the organic aminophosphonic acid precursor is a polyalkylenepolyamine wherein at least about 50 percent of the amine hydrogens have been substituted by methylenephosphonic acid groups or salts thereof.

55. The method of claim 54 wherein at least about 10 percent of the amine hydrogens have been substituted by 2-hydroxy-3-trialkylammonium halide)propyl groups and substantially all of the remainder have been substituted by methylenephosphonic acid groups or salts thereof.

56. The method of claim 54 wherein at least about 25 percent of the amine hydrogens have been substituted by 2-hydroxy-3-trialkylammonium halide)propyl groups and substantially all of the remainder have been substituted by methylenephosphonic acid groups or salts thereof.

57. The method of claim 54 wherein substantially all of the amine hydrogens have been substituted by methylenephosphonic acid groups or salts thereof.

58. The method of claim 54 wherein the organic aminophosphonic acid derivative is a phosphonomethylated poly(aminoethylpiperazine).

59. The method of claim 57 wherein the polyalkylenepolyamine precursor has an average molecular weight of about 275.

60. The method of claim 59 wherein the manganese ion is supplied in a chelated form.

61. The method of claim 58 wherein the organic aminophosphonic acid precursor is a polyalkylenepolyamine wherein at least about 50 percent of the amine hydrogens have been substituted by methylenephosphonic acid groups or salts thereof.

62. The method of claim 55 wherein the manganese ion is supplied in a chelated form.

63. The method of claim 56 wherein the manganese ion is supplied in a chelated form.

64. The method of claim 57 wherein the manganese ion is supplied in a chelated form.

65. The method of claim 58 wherein the manganese ion is supplied in a chelated form.

66. The method of claim 39 wherein a dispersing agent is also added to the water system.

67. The method of claim 66 wherein the dispersing agent is a polymer of acrylic acid, methacrylic acid or maleic anhydride or a copolymer of acrylic and methacrylic acids, acrylic acid and acrylamide or salts thereof.

68. The method of claim 39 wherein a biocide is also added to the water system.

69. The method of claim 68 wherein the biocide is 2,2-dibromo-2-nitrilopropionamide or bis(tributyltin-)oxide.

70. The method of claim 39 wherein an antifoam agent is also added to the water system.

71. The method of claim 46 wherein a dispersing agent is also added to the water.

72. The method of claim 71 wherein the dispersing agent is a polymer of acrylic acid, methacrylic acid or maleic anhydride or a copolymer of acrylic and methacrylic acids, acrylic acid and acrylamide or salts thereof.

73. The method of claim 71 wherein the dispersing agent is a polyacrylic acid based dispersant.

74. The method of claim 71 wherein a biocide is also added to the water system.

75. The method of claim 71 wherein an antifoam agent is also added to the water system.

* * * * *